US005339746A

United States Patent [19]

Vannatta

[11] Patent Number: 5,339,746

[45] Date of Patent: Aug. 23, 1994

[54] PALLET LEG ASSEMBLY

[75] Inventor: Truman J. Vannatta, Lynchburg, Va.

[73] Assignee: Rock-Tenn Company, Norcross, Ga.

[21] Appl. No.: 892,257

[22] Filed: Jun. 2, 1992

[51] Int. Cl.[5] ..... B65D 19/12

[52] U.S. Cl. ..... 108/56.3; 108/51.3

[58] Field of Search ..... 108/51.3, 56.3

[56] References Cited

U.S. PATENT DOCUMENTS

| | | | |
|---|---|---|---|
| 2,444,183 | 6/1948 | Cahners | 108/51.3 |
| 2,446,914 | 8/1948 | Fallert . | |
| 2,493,562 | 1/1950 | Yarman . | |
| 2,503,240 | 4/1950 | Cahners . | |
| 2,576,715 | 11/1951 | Farrell | 108/51.3 |
| 2,609,136 | 9/1952 | Sider . | |
| 2,728,545 | 12/1955 | Hermitage | 108/56.3 |
| 2,914,282 | 11/1959 | Budd . | |
| 3,115,105 | 12/1963 | Allen . | |
| 3,747,831 | 7/1973 | Hanson . | |
| 4,102,525 | 7/1978 | Albano | 108/51.3 |
| 4,117,924 | 10/1978 | Growney . | |
| 4,416,412 | 11/1983 | Wischusen, III . | |
| 4,759,295 | 7/1988 | Nilsen et al. | 108/51.3 |

FOREIGN PATENT DOCUMENTS

| | | | |
|---|---|---|---|
| 928141 | 6/1963 | United Kingdom | 108/51.3 |
| 957762 | 5/1964 | United Kingdom | 108/51.3 |
| 1282560 | 7/1972 | United Kingdom | 108/51.3 |

*Primary Examiner*—Michael Milano
*Attorney, Agent, or Firm*—Jones & Askew

[57] ABSTRACT

A pallet leg assembly having vertical support members which are reinforced from buckling or crushing. A first embodiment of the invention includes a sleeve defining a horizontal axis therethrough consisting of horizontal top and bottom panels with two side panels extending therebetween. A vertical support member is interposed in the sleeve and at least one diagonal support panel extends from the juncture of the side panels and either the top panel or the bottom panel to a location on the vertical support member. Another embodiment provides inner and outer sleeves with horizontal axes therethrough used with a vertical support member. The inner sleeve is journaled in the outer sleeve and the support member is positioned in the inner sleeve between the top and bottom of both the outer and inner sleeves.

13 Claims, 5 Drawing Sheets

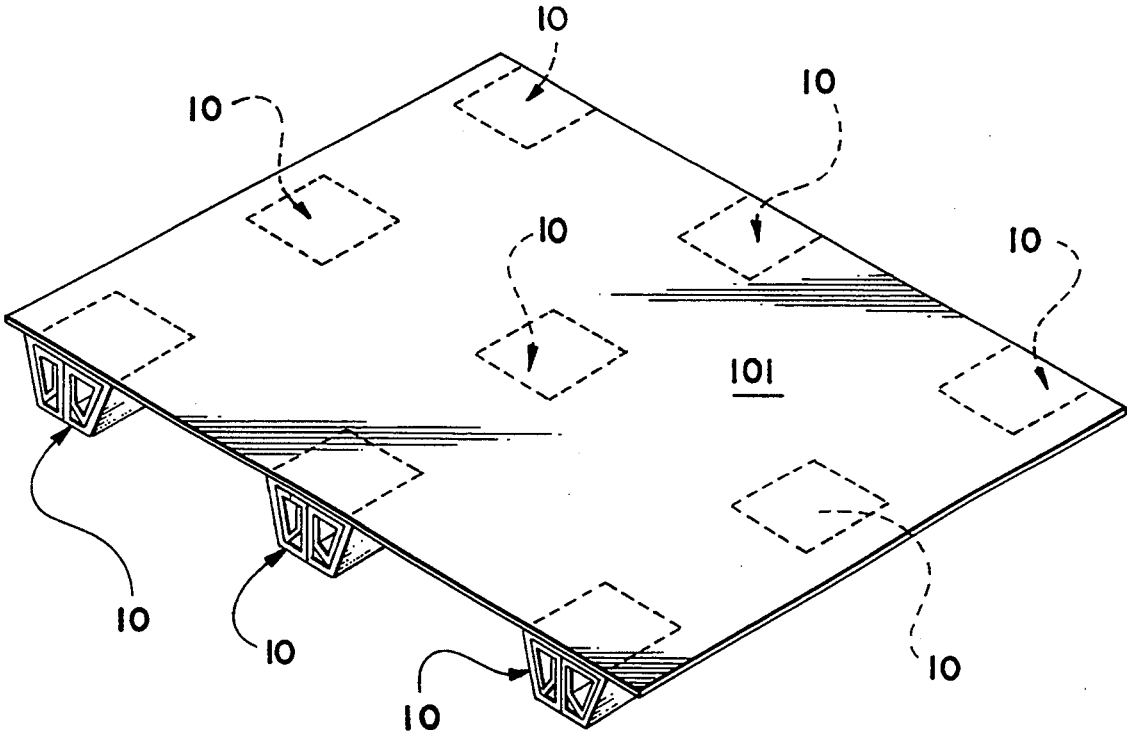
Fig. 13
Fig. 14
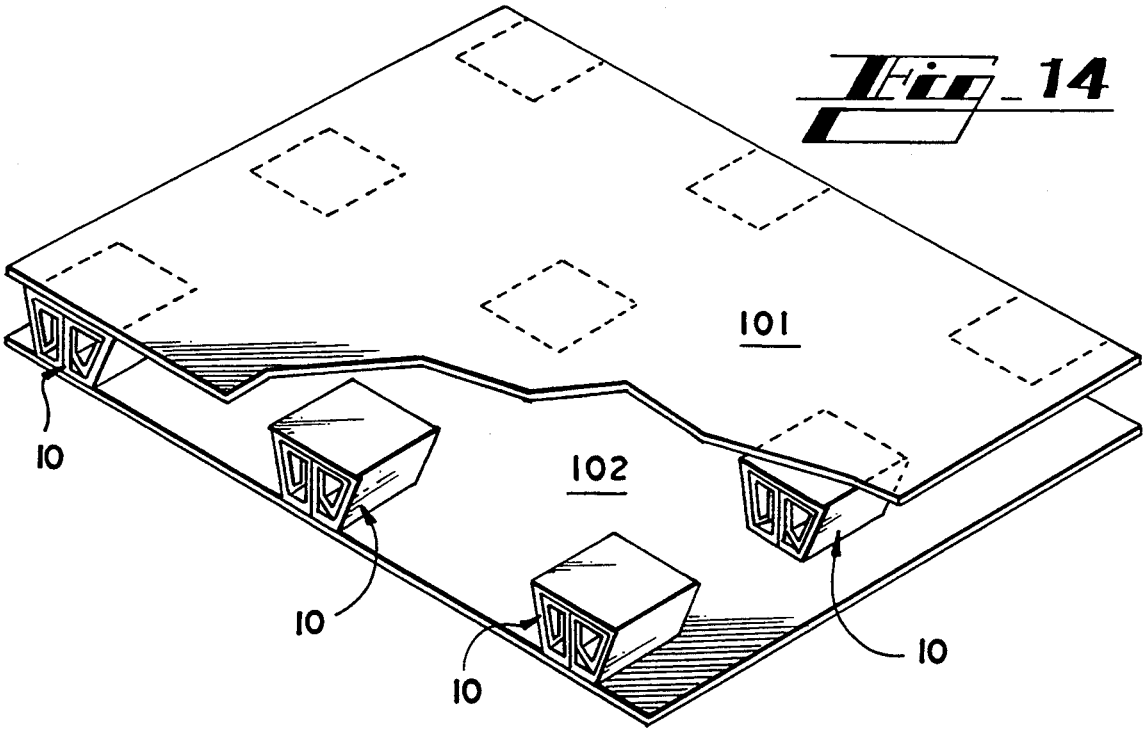

PALLET LEG ASSEMBLY

FIELD OF INVENTION

This invention relates in general to a load-supporting structure and more particularly relates to a paperboard pallet leg.

BACKGROUND OF THE INVENTION

Interest in recycling has drawn attention to many fields in which waste previously went unnoticed. Included among these is the pallet building industry. The wooden and steel pallets in current use not only contribute to shipping costs due to their weight and expensive space consumption, but also create uneconomical waste after use. If the pallets are one-use platforms, they create instant waste after shipment. One-use wooden pallets may take up valuable landfill space or may create pollutants if they have to be burned. If the pallets are reusable they may require return shipment. The wooden pallets are easily damaged after a few uses, which creates further waste.

Use of a paperboard pallet is a ready solution to the above-mentioned problems. However, a pallet made of paperboard must have the necessary structure to be functional yet be able to withstand large loads. A standard pallet consists of an upper pallet deck for contacting a load and pallet legs extending downwardly from the pallet deck. A bottom pallet deck or stringers may be provided for stability of the pallet legs or easier stacking. The pallet legs are spaced such that prongs of a fork lift may be inserted under the upper pallet deck and between the legs to lift the pallet deck.

In order for the pallet leg of a paperboard pallet to give proper support, at least one member of the pallet leg must provide vertical support. However, attaching a pallet leg which includes a member that gives vertical support to the horizontal pallet deck may be difficult and the prior art approaches of attaching pallet legs to the pallet strip have been unsatisfactory. Examples of patents disclosing paperboard pallet assemblies are U.S. Pat. Nos. 2,446,914 to Fallert et al.; 2,503,240 to Cahners; 3,115,105 to Allen; 2,914,282 to Budd; and 2,493,562 to Yarman.

The patents to Cahners, Allen and Fallert create pallet legs with vertical support members by using a sleeve which is attached between pallet decks. The sleeve is oriented so that its axis extends horizontally and the vertical support members are inserted into the sleeve. Cahners shows reinforcing members with diagonal or X-shaped members which are slipped into a sleeve. Similarly, Allen shows a pallet leg in which the sleeve and vertical reinforcing member are formed from a single blank and an X-shaped configuration results. Fallert shows several embodiments; in one of these, an elongate sleeve contains packed, upstanding pieces of board. In other embodiments in Fallert, a length of board is folded in a zig-zag fashion and inserted into the sleeve, with the openings in the zig-zag oriented vertically or horizontally. Although each of these pallet legs provides a modicum of support and stability, when a large amount of weight is applied to the leg, there is a possibility that the members of the pallet legs lending vertical support will buckle or bend. There is a need for a means of supporting these members of the pallet legs to prevent this bending or buckling.

Even if the pallet legs are capable of withstanding the entire load on the pallet deck, unequal distribution of the load on the deck may cause sagging of the deck. Therefore, it is advantageous to be able to strategically position the pallet legs in response to unevenly distributed loads.

Thus, in order to solve the problems encountered in the prior art, a pallet leg must be attached individually to a pallet deck and must give a wide degree of vertical as well as lateral support without bending or buckling. To avoid waste, the pallet needs to be made of a recyclable material and must be recyclable.

SUMMARY OF THE INVENTION

The present invention solves the above-mentioned problems by providing a paperboard pallet leg with vertical support members which are reinforced from buckling or crushing. In addition, the pallet leg provides horizontal members which can be accessed for stapling the pallet legs to pallet decks.

Generally described, the pallet leg of the present invention comprises a horizontal, load-contacting panel and a horizontal bottom panel. At least one side panel extends from the bottom panel to the load-contacting panel and a vertical, load-bearing panel is disposed between the load-contacting panel and the bottom panel. At least one diagonal support panel extends from one of the top or bottom panels to a location on the vertical panel intermediate the load-contacting panel and the bottom panel. The diagonal support panel lies in a plane parallel to the line of intersection between the load-contacting panel and the vertical panel and provides reinforcement for the vertical, load-bearing panel so that it will not bend or buckle. In addition, the horizontal, load-contacting panel and horizontal bottom panel provide areas for attachment of the pallet leg to the pallet decks. A preferred embodiment of the invention comprises a single strip of paperboard which is folded to form the pallet leg.

In a preferred embodiment of the present invention, the pallet leg comprises two side panels which, with the top and bottom panels, form a tubular member defining a horizontal axis therethrough. The vertical support panel is interposed in the tubular member substantially parallel to the horizontal axis of the tubular member and two diagonal support members extend from the juncture of the side panels and either the top or the bottom panel to a location on the vertical support member intermediate the top and bottom panels. Preferably, the cross-section of the tubular member comprises an inverted trapezoid with the longer base being the top segment. This extended top panel provides a large area in which to staple or glue the pallet leg to an upper pallet deck and extends the area of deck supported by the leg to help prevent sagging of the deck.

Alternately described, with reference to a preferred embodiment, the present invention provides a pallet leg comprising an inner sleeve having a first, second, third, and fourth inner panels journalled inside a outer sleeve comprising a first, second, third and fourth outer panels. The second outer panel is vertical and the first and third outer panels are substantially parallel. The first inner panel extends from a location adjacent the joining point of the first outer panel and the fourth outer panel to a location on the second outer panel intermediate the first outer panel and the third outer panel. The second inner panel extends from the first inner panel substantially parallel to the second outer panel to a location adjacent the third outer panel. The third inner panel extends from the second inner panel substantially parallel to the third outer panel and the fourth inner panel extends from the third inner panel substantially parallel to the fourth outer panel. A second pallet leg of this construction may be added wherein the second outer panels of the first pallet leg and the second pallet leg are in facing relationship to one another.

In addition, the present invention provides an elongate paperboard blank for forming a pallet leg and a method of forming the pallet leg from the blank. The blank comprises an outer load-contacting panel, an outer side panel foldably connected to the load-contacting panel, a bottom panel foldably connected to the outer side panel, a load-bearing panel foldably connected to the bottom panel, an inner top panel foldably connected to the load-bearing panel, an inner side panel foldably connected to the inner top panel, and a diagonal panel foldably connected to the inner side panel. A glue panel may be provided which is foldably connected to the diagonal panel. In order to form the pallet leg from the blank, first a trapezoidal sleeve is formed, consisting of the glue panel, the diagonal panel, the inner side panel, and the inner top panel, wherein the glue panel is adhered to the load-bearing panel and extends along the load-bearing panel from a location adjacent to the line of contact between the inner top and load-bearing panels to the diagonal panel, which angles downwardly and outwardly to the lower corner of the trapezoid. After forming this trapezoid, the bottom panel is folded outwardly relative to the load-bearing panel such that the fold line between the bottom panel and the outer side panel is adjacent the fold line between the diagonal and the inner side panels. The outer side panel is then folded relative to the bottom panel such that the outer side panel extends adjacent to the inner side panel. Last, the outer load-contacting panel is folded relative to the outer side panel such that the outer load-contacting panel extends adjacent to the inner top panel.

The blank may extend from the outer load-contacting panel to create a two-component pallet leg with two legs such that when the two-component pallet leg is formed, the load-bearing panels of each component of the pallet leg are in facing relationship to each other. This results in a trapezoid with double-thick sides and a central load-bearing support. In order to give the maximum support, the glue panels extend from the diagonal panels to the inner top panels. Bar scores may be provided between the load-bearing panels and the inner top panels and the glue panels may extend to the bar scores. Other bar scores are preferably provided between the outer side panels and the bottom panels with the diagonal panels extending from these bar scores. A bar score may also be located between the outer load-bearing panel and the outer side panel with a corresponding slit score between the inner top panel and the inner side panel, the slit scores aligned against the bar scores upon assembly of the pallet leg.

Another embodiment of the present invention provides a pallet leg comprising an outer sleeve defining a top and bottom thereon with its tubular axis extending substantially horizontally, and an inner sleeve defining a top and bottom thereon journalled at least partly in the outer sleeve, the inner sleeve's tubular axis being substantially horizontal and extending substantially perpendicular to the tubular axis of the outer sleeve. A vertically-oriented support member is positioned in the inner sleeve between the top and bottom of both the outer and inner sleeves. The cross-sections of the outer and inner sleeves are preferably both trapezoidal with the longer base of the trapezoid facing upwardly. This trapezoidal shape not only adds support for lateral loads, but also provides a place to staple the pallet leg to a pallet deck. The outer sleeve may be positioned relative to the inner sleeve by a shoulder formed on said inner sleeve which keeps the outer sleeve from sliding relative to the inner sleeve. The vertical support member may be in the form of a cylinder with its tubular axis aligned in a vertical orientation or may be a vertical support comprising a vertically-oriented tube with a diagonal support crossing the tube.

Therefore, it is an object of this invention to provide an improved pallet leg.

It is an associated object of the present invention to provide an improved paperboard pallet.

It is a further object of the present invention to provide a paperboard pallet from a recycled material which is able to carry heavy loads.

It is a further object of this invention to provide a pallet leg with vertical support reinforced to prevent bending or buckling.

Yet another object of the present invention is to provide a pallet leg which may be easily attached to a pallet deck.

Still a further object of this invention is to provide a pallet leg which may be formed from a single strip of paperboard which is folded to form the assembly.

Other objects, features, and advantages of the present invention will become apparent upon reading the following detailed description, with reference to the drawing.

BRIEF DESCRIPTION OF THE DRAWING

FIG. 13 is a top pictorial view of a pallet deck utilizing nine of the pallet legs of FIG. 1.

FIG. 14 is a cutaway pictorial view of the pallet deck of FIG. 13 with a lower deck attached along the bottom of the pallet legs.

DETAILED DESCRIPTION OF THE DRAWING

Figure 1:
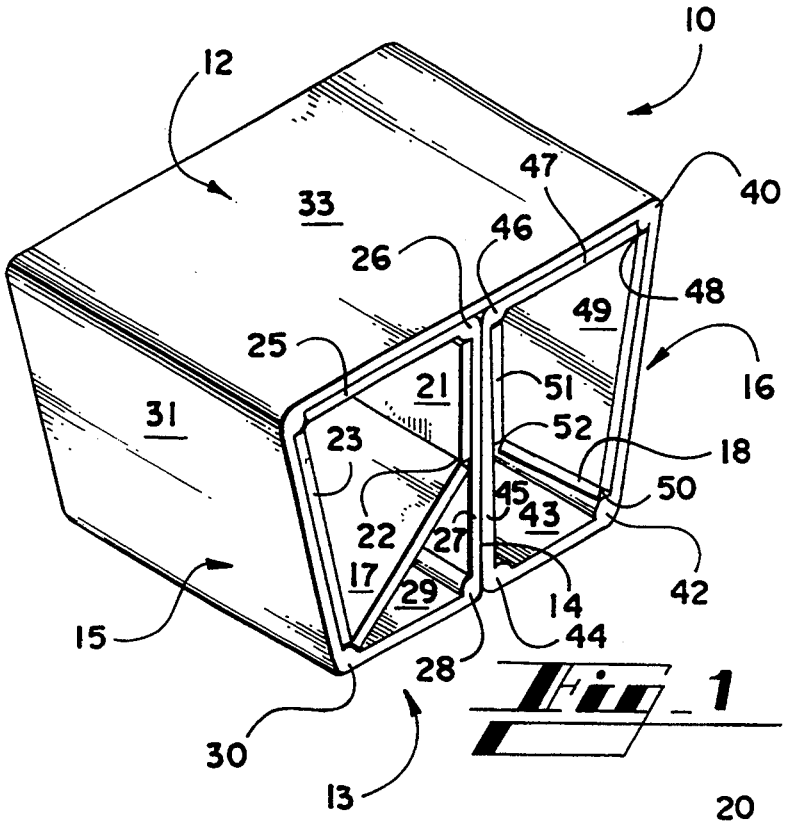
FIG. 1 is a top perspective view of a first embodiment of the pallet leg of the present invention.

Referring now in more detail to the drawing, in which like numerals refer to like parts throughout the several views, FIG. 1 shows a pallet leg 10 embodying the present invention. As can be best seen in FIG. 2, the pallet leg 10 comprises a top wall 12 and a shorter bottom base 13. A vertical support 14 extends from the top wall 12 to the base 13. Two side walls 15 and 16 slope inwardly from ends of the top wall 12 to the ends of the shorter base 13. This type of construction increases lateral breadth of load support and lateral stability. The pallet leg 10 provides diagonal panels 17 and 18 to prevent bending or buckling of the vertical support 14. Preferably, these diagonal panels 17 and 18 extend from the fold lines joining the side walls 15 and 16 and the base 13 to the vertical support 14 approximately half way between the top wall 12 and the base 13. To provide maximum support, the diagonal panels 17 and 18 extend to points just opposite each other on the vertical support 14. As shown, the pallet leg 10 includes a pair of tubes side-by-side beneath the top wall 12, as described in detail below.

Figure 3:
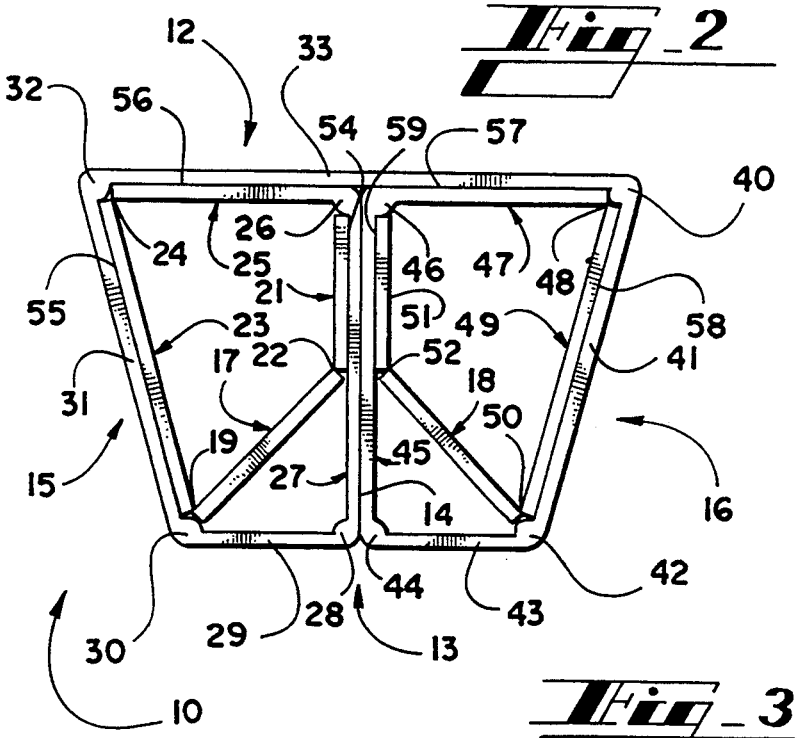
FIG. 3 is a plan view of the inner surface of a blank used to form the pallet leg of FIG. 1.

FIG. 3 shows a blank 20 for making the pallet leg 10 shown in FIG. 1. Starting from the top of FIG. 3, the blank 20 comprises a glue panel 21 foldably connected by means of a slit score 22 to the diagonal panel 17. All slit scores are cut and all bar scores are pressed into the outer surface (not shown) of the blank 20. The diagonal panel 17 is foldably connected by means of a slit score 19 to an inner side panel 23. The inner side panel is foldably connected by means of a slit score 24 to an inner top panel 25. This inner top panel 25 is foldably connected by means of a bar score 26 to a vertical panel 27. The vertical panel 27 is foldably connected by means of a bar score 28 to a bottom panel 29. The bottom panel 29 is foldably connected by means of a bar score 30 to an outer side panel 31. The outer side panel 31 is foldably connected by means of a bar score 32 to a top panel 33. The blank 20 then repeats the same elements in reverse order to the other end of the blank. Thus, from the top panel 33, the following elements occur in top to bottom order: bar score 40, second outer side panel 41, bar score 42, second bottom panel 43, bar score 44, second vertical panel 45, bar score 46, second inner top panel 47, slit score 48, second inner side panel 49, slit score 50, second diagonal panel 18, slit score 52, and second glue panel 51.

So that the blank 20 may be held together upon assembly, glue areas are preferably provided at 54, 55, 56, 57, 58, and 59 on the inner vertical panels 27 and 45, the outer side panels 31 and 41 and the top panel 33. In addition, glue may be applied between the panels 27 and 45 after complete assembly. Although the pallet leg 10 may be glued at each of these areas, staples or stitches may replace the glue to hold the leg 10 together. As a practical matter, glue is best used between the two inner vertical panels 27 and 45 because of the difficulty of stapling or stitching four layers of paperboard together. Furthermore, the tightness of construction around these panels prevents easy manipulation of stapling or sewing arms into a position to attach the panels. The description of a panel as a "glue panel" does not mean that an alternate attachment method cannot be used.

Figure 4:
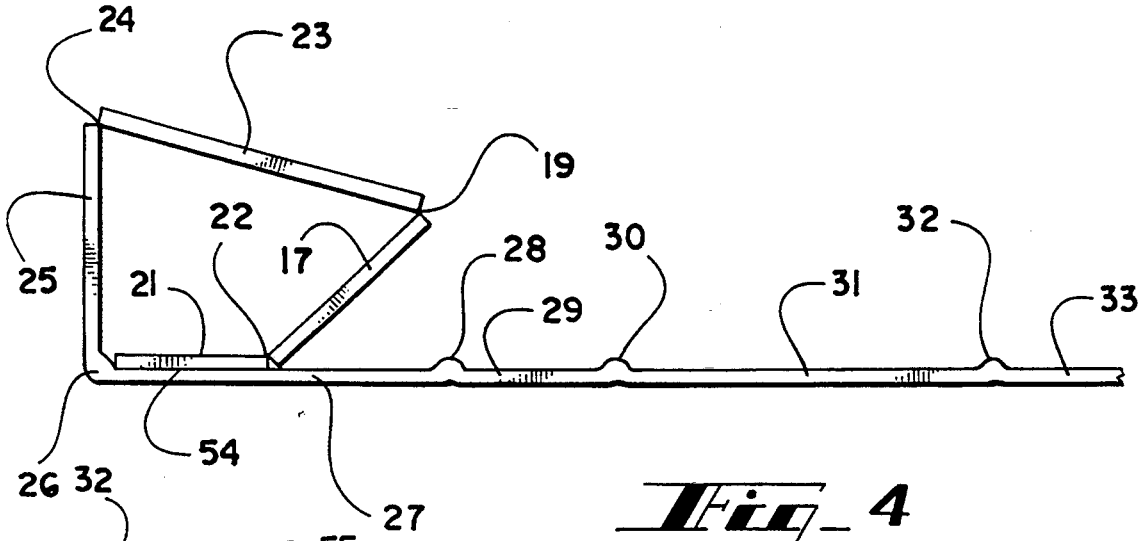
FIG. 4 shows the blank of FIG. 3 at a first stage of assembly.

As can be seen in FIG. 4, assembly of the pallet leg 10 from the blank 20 begins by forming a sleeve with the glue panel 21, the diagonal panel 17, the inner side panel 23, and the inner top panel 25. The glue panel 21 preferably rests against the bar score 28 and extends across the glue area 54 of the vertical panel 27 to which it is attached by gluing, stapling or stitching. Following the formation of the sleeve, the vertical panel 27 is folded relative to the bottom panel 29 about the score 28 and the bottom panel 29 is folded relative to the outer side panel 31 about the score 30 such that the inner side panel 23 comes to rest against the outer side panel 31. The slit scores 19 and 24 on either side of the inner side panel 23 preferably abut the bar scores 30 and 32 on either side of the outer side panel.

Figure 5:
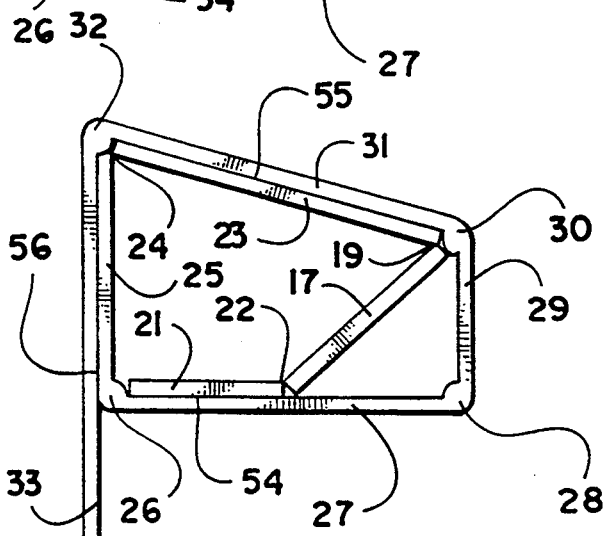
FIG. 5 shows the blank of FIGS. 3 and 4 in a further stage of assembly.
Figure 6:
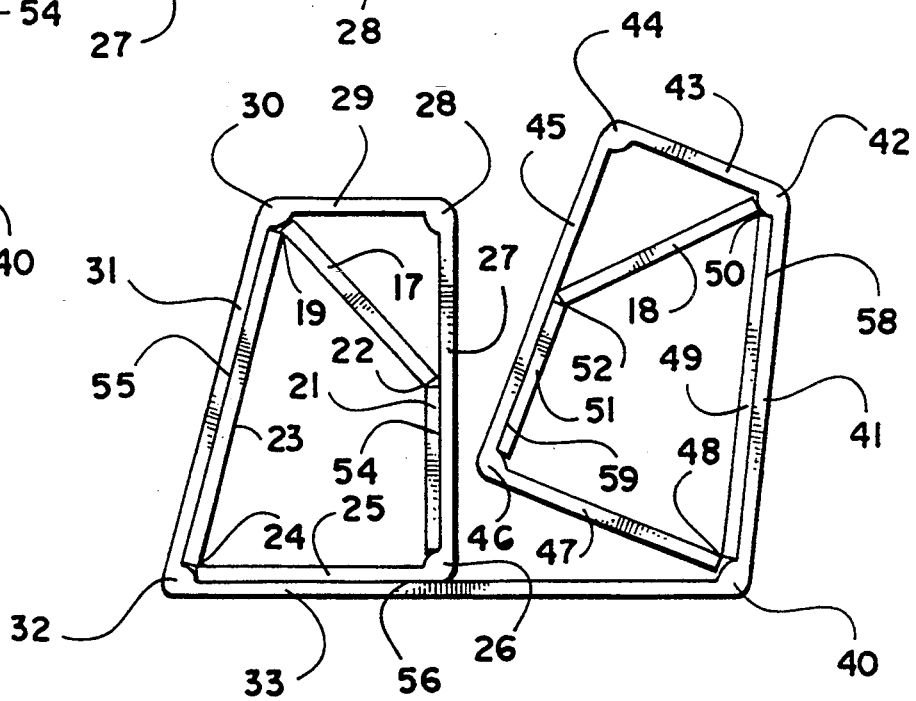
FIG. 6 shows the blank of FIGS. 3–5 in a further stage of assembly.
Figure 7:
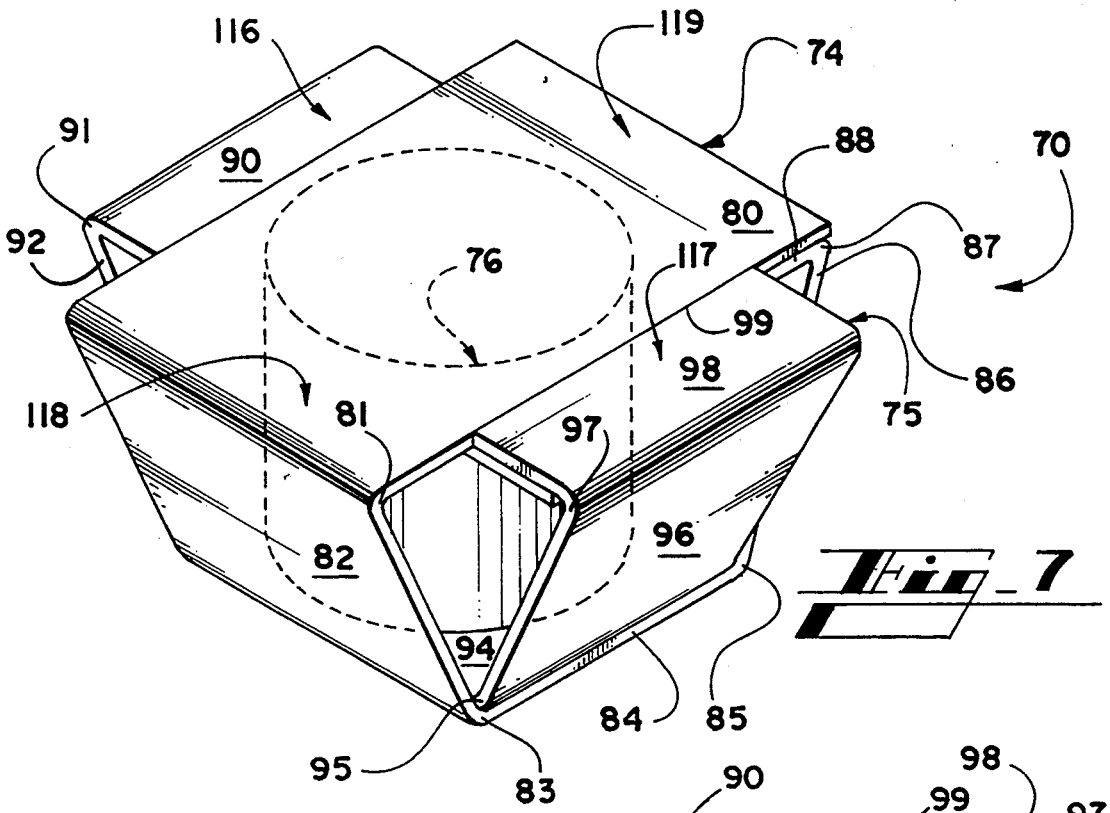
FIG. 7 shows a top perspective view of a second embodiment of a pallet leg assembly according to the invention.

For the next step of the assembly, the outer side panel 31 is folded relative to the top panel 33 such that the inner top panel 25 comes to rest against the top panel 33 at the glue area 56, as is shown in FIG. 5. The top panel 33 may then be attached to the inner top panel 25 by gluing, stapling, or stitching. The bottom side of the blank 20 in FIG. 3 is folded in the same manner so that the vertical panels 27 and 45 are in facing relationship, as is shown in FIG. 6. Upon completion of assembly of the blank 20, the panels 23 and 31 form side wall 15 and the panels 41 and 49 form side wall 16. Likewise, the panels 27 and 45 form the vertical support 14. The top wall 12 is formed from the panels 25, 33, and 47 and the base 13 is formed from the panels 29 and 43.

Figure 2:
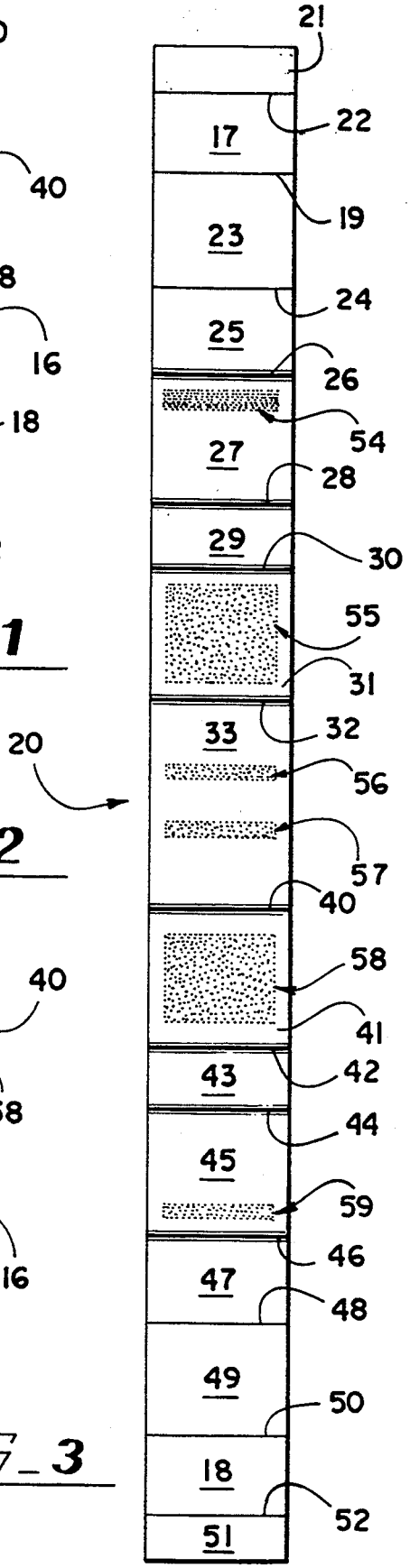
FIG. 2 is a front plan view of the pallet leg of FIG. 1.

As can be seen by the front plan view in FIG. 2, the diagonal panels 17 and 18 provide support for the vertical panels 27 and 45 to prevent the vertical panels 27 and 45 from bending or buckling upon application of a vertical load. The construction of the pallet leg 10 with the side panels 15 and 16 sloping inward from the top panel 12 to the bottom panel 13 also provides lateral support. The design of the pallet leg 10 enables an area of a stapler to enter one or both of the tubes to staple the leg 10 to a deck or directly to the item to be shipped.

As can be seen from the drawing, the top wall 12, bottom base 13, and side walls 15 and 16 preferably define a trapezoidal sleeve with the top wall being a longer base of the trapezoid and the bottom base being a shorter base of the trapezoid. In the preferred embodiment of the invention, each of panels 21, 17, 23, 25, 27, 29, 31, 33, 41, 43, 45, 47, 49, 18, 51 is located in planes which are parallel to a central axis of this trapezoidal sleeve. This central axis would extend perpendicular to the plane of the page in FIG. 2.

The use of the slit and large bar scores 22, 19, 24, 48, 50, 52, 26, 28, 30, 32, 40, 42, 44 and 46 in the embodiment shown adds additional stability for the pallet leg 10. The large bar scores 30, 32, 40 and 42 provide positions for the slit scores 19 24, 48 and 50 to abut. In addition, the glue panels 21 and 51 abut the bar scores 26 and 46. Forces extending through the length of the internal panels 21, 17, 23, 25, 47, 49, 18 and 51 are thus transferred to the bar scores instead of walls to further prevent bending and buckling of members. The large bar scores also "give" or compress in height when a vertical force is first applied to the pallet leg 10. After this initial slight collapse, the pallet leg attains a stable height. A pallet leg having the design of the pallet leg 10 and made of double craft line paperboard having a thickness of 0.098 inches has been tested to withstand in excess of 2,000 pounds. A second embodiment of the present invention is shown in FIGS. 7–12. The pallet leg 70 includes a vertical support 76 journalled in an inner sleeve 75 which is journalled in an outer sleeve 74.

Figure 9:
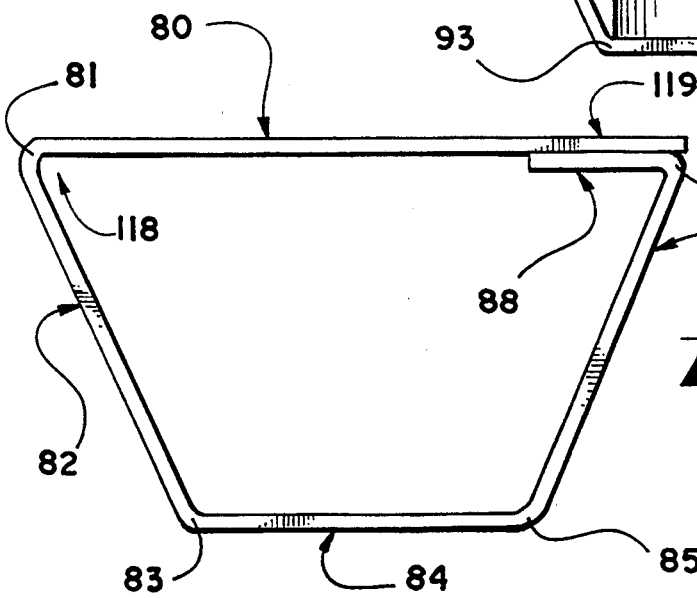
FIG. 9 a side plan view of the outer sleeve of the pallet leg of FIG. 7.

The outer sleeve 74 is shown in FIG. 9. A top panel 80 extends across the length of the outer sleeve 74 and is foldably connected by means of a bar score 81 to a first side panel 82. This side panel 82 is foldably connected by a bar score 83 to a bottom panel 84. The bottom panel in turn is foldably connected by means of a bar score 85 to a second side panel 86. This second side panel is foldably connected to a glue panel 88 which extends under the top panel 80 and completes the outer sleeve 74. The top panel 80 of the outer sleeve 74 is preferably larger than the bottom panel 84 to extend support laterally.

Figure 8:
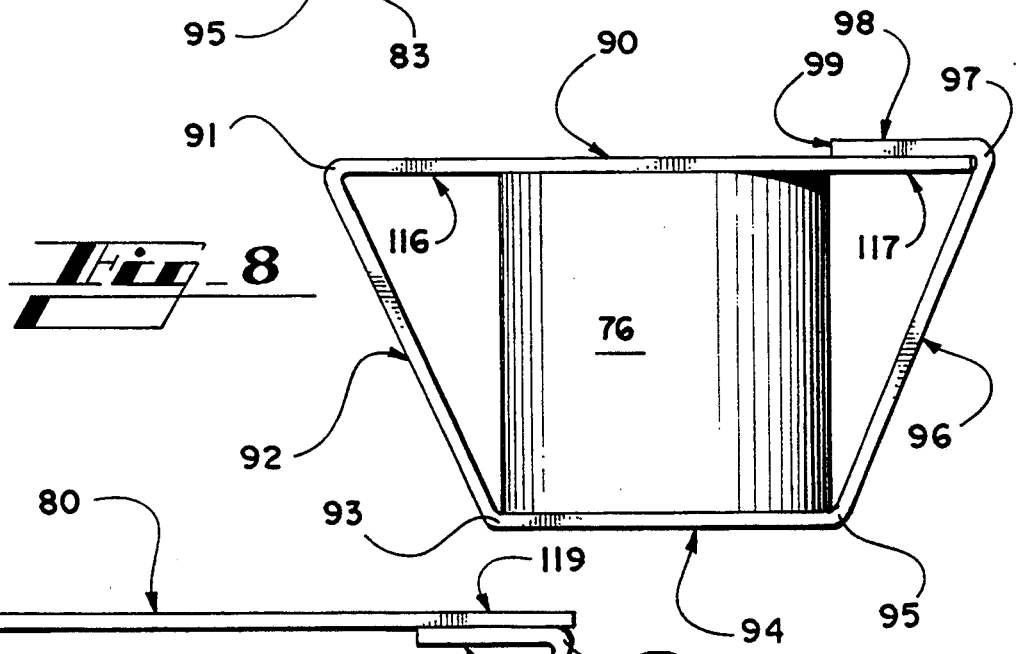
FIG. 8 a front plan view of the pallet leg of FIG. 7 with the outer sleeve removed.

As can be best seen in FIG. 8, the inner sleeve is constructed in a manner similar to the outer sleeve and includes the following members: the top panel 90, a bar score 91, a first side panel 92, a bar score 93, a bottom panel 94, a bar score 95, a second side panel 96, a bar score 97, and a glue panel 98. The glue panel 98 on the inner sleeve 75 extends over the top of the top panel 90 so as to form a shoulder 99 to positively position the inner sleeve 75 relative to the outer sleeve 74, as can best be seen in FIG. 10.

Figure 11:
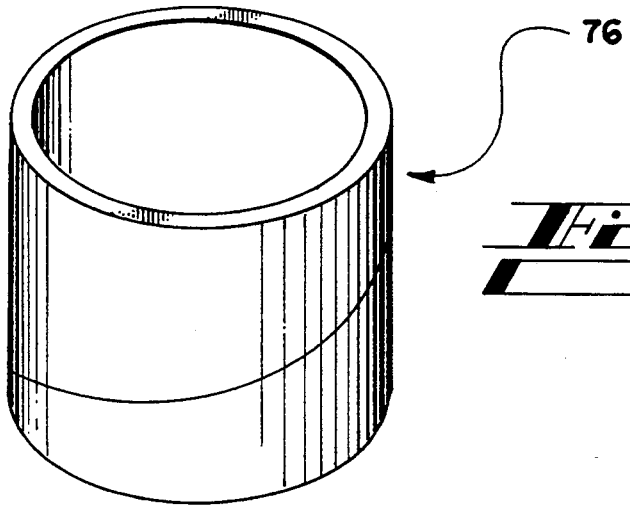
FIG. 11 a top perspective view of the vertical support member for the pallet in FIG. 7, the vertical support member shown as a cylindrical member.
Figure 12:
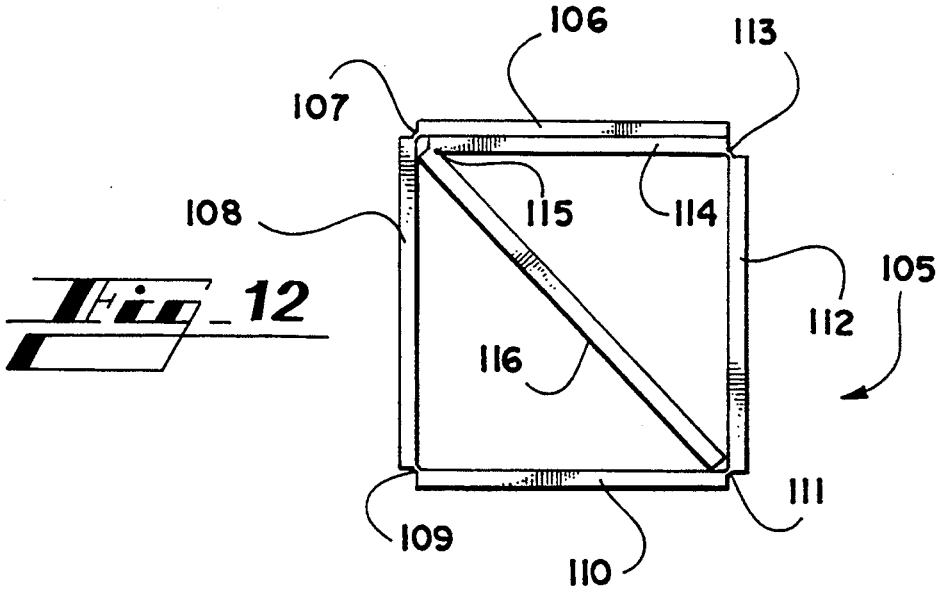
FIG. 12 a top plan view of an alternate embodiment of the vertical support member for the pallet leg of FIG. 7.

To prevent movement of the vertical support 76 within the sleeves 74 and 75, the lateral dimensions of the support 76 are preferably substantially equal to the inside lateral dimensions of the bottom panels 84 and 94. Although the vertical support member may take various forms, a preferred embodiment of the support 76 is shown in FIG. 11. This embodiment of the support 76 is a spiral wrapped paperboard cylinder of the type well known in the art. An alternative embodiment of the present invention comprises a rectangular sleeve with a diagonal member interposed within the sleeve. This vertical support member 105, formed from a single strip of paperboard, is shown in FIG. 12. The support 105 consists of a first panel 106 foldably connected by a slit score 107 to a second panel 108 which is in turn foldably connected by a slit score 109 to a third panel 110. A fourth panel 112 is foldably connected to this third panel 110 by a slit score 111 to form the complete outer sleeve. This fourth panel 112 is foldably connected by a slit score 113 to a fifth panel 114 which extends inside the sleeve parallel to the first panel 106. A diagonal panel 116 is foldably connected to the fifth panel 114 by means of a slit score 115. The end of the diagonal panel 116 away from the slit score 115 abuts the corner formed by the third panel 110 and fourth panel 112.

Figure 10:
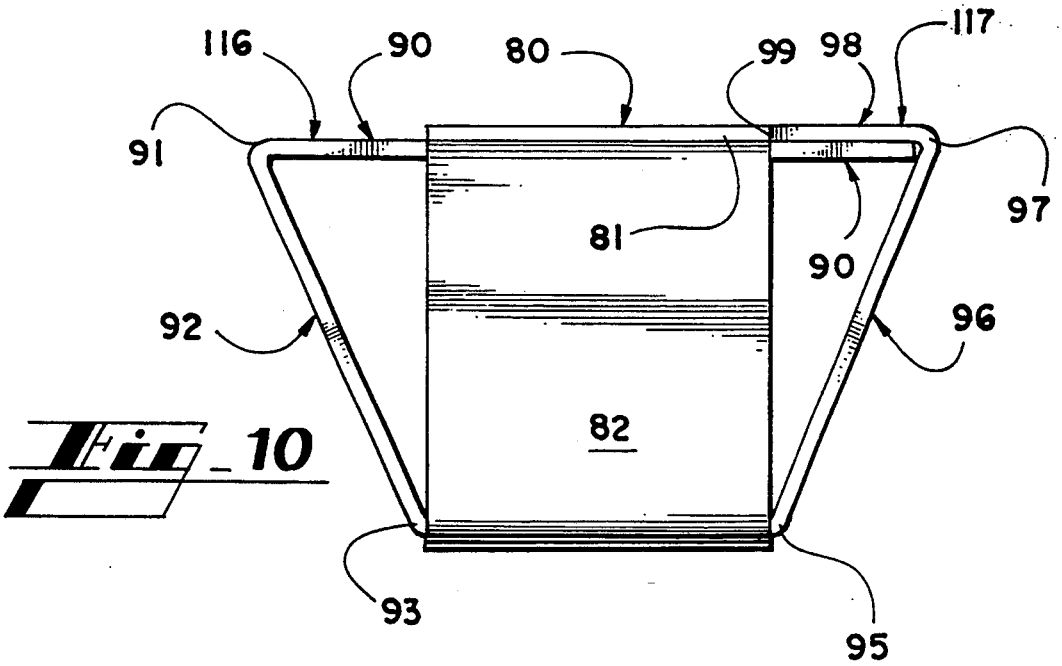
FIG. 10 a front plan view of the pallet leg of FIG. 7.

In order to assemble the pallet leg 70, the vertical support member 76 is first inserted into the inner sleeve 75 as shown in FIG. 8. The inner sleeve 75 and the vertical support 76 are then journalled into the outer sleeve 74 until the shoulder 99 of the inner sleeve 75 abuts the outer sleeve, as is shown in FIG. 10. The pallet leg 70 is then ready to be attached to a pallet deck for use. The pallet leg 70 comprises four staple areas 116, 117, 118, and 119 which enable an arm of stapler to be inserted into the sleeve for stapling the pallet leg 70 to a pallet deck. The staples may be removed after use and the pallet leg 70 may be reused on another pallet deck.

A pallet deck 101 for use with any of the embodiments of the present invention is pictured in FIG. 13. The pallet deck 101 comprises a paperboard sheet, the thickness of which may be adjusted according to the load. Pallet legs 10 or 70 are attached in various positions along the pallet deck 101 such that the load on the pallet is held without significant sagging of the deck and such that the prongs of a typical fork lift (not shown) may be inserted between the legs and under the deck 101. If pallet legs 10 are used, a lower deck (102) or stringers (not shown) may be stapled across the bottom of the pallet legs 10, as is shown in FIG. 14. The legs 10 or 70 are preferably stapled to the decks. In addition to being convenient, stapling places a fastener through the entire deck and thicknesses of the leg for a secure joint. Glued joints may tend to come apart, or the layers of paperboard may delaminate under stress. Further, if desired, the staples may be removed. In the embodiment shown in FIG. 13, nine pallet legs 10 are stapled to the deck 101 such that the legs form three rows of three legs 10. Fork lift prongs may be inserted between the rows in order to lift the deck 101 and its contents. The position and number of the legs 10 may be varied according to the distribution of the load on the deck. In an alternate embodiment of a pallet including the pallet legs 10, the legs 10 may be more elongate and extend the length of the pallet deck 101. In this form, the pallet would need only three of the elongate legs.

While this invention has been described in detail with particular reference to preferred embodiments thereof, it will be understood that variations and modifications can be affected within the spirit and scope of the invention as described hereinbefore and as defined in the appended claims.

What is claimed is:

1. A pallet leg assembly comprising:

a horizontal, load-contacting panel;

a horizontal bottom panel;

at least one side panel extending from said bottom panel to said load-contacting panel;

a vertical, load-bearing panel disposed between ends of said load-contacting panel and said bottom panel and extending substantially perpendicular to said bottom panel;

at least one diagonal support panel lying in a plane parallel to the line of intersection between said load-contacting panel and said vertical panel, and extending from one of said load-contacting and bottom panels to a location on said vertical panel intermediate said load-contacting panel and said bottom panel, said location being spaced apart from said load-contacting and bottom panels.

2. The assembly of claim 1, wherein said diagonal support panel extends from said bottom panel at a location adjacent to said side panel.

3. The assembly of claim 2, wherein said diagonal support panel extends to a position on said vertical panel approximately half way between said load-contacting panel and said bottom panel.

4. The assembly of claim 3, wherein said assembly comprises a single strip of paperboard which is folded to form the assembly.

5. The assembly of claim 1, wherein said assembly comprises paperboard.

6. The assembly of claim 5, wherein said assembly comprises a single strip of paperboard which is folded to form the assembly.

7. The assembly of claim 1, wherein the number of side panels is two;

said side panels, said load-contacting panel, and said bottom panel form a tubular member defining a central axis therethrough;

said vertical panel is interposed in said tubular member substantially parallel to said central axis; and said diagonal support member lies in a plane substantially parallel to said central axis.

8. The assembly of claim 2, wherein a cross-section of said tubular member comprises a trapezoid and wherein said load-contacting panel is longer than said bottom panel.

9. The assembly of claim 8, wherein said diagonal support extends from a position on said bottom panel adjacent to one of said side panels to a location on said vertical panel approximately one-half way between said load-contacting and bottom panels.

10. The assembly of claim 2, wherein said pallet leg comprises a single strip of paperboard which is folded to form the pallet leg.

11. A pallet leg assembly comprising a single strip of paperboard which is folded to form the assembly, said assembly comprising:

a horizontal, load-contacting panel;

a horizontal bottom panel;

at least one side panel extending from said bottom panel to said load-contacting panel;

a vertical, load-bearing panel disposed between ends of said load-contacting panel and said bottom panel;

at least one diagonal support panel lying in a plane parallel to the line of intersection between said load-contacting panel and said vertical panel, and extending from one of said load-contacting and bottom panels to a location on said vertical panel intermediate said load-contacting panel and said bottom panel.

12. A pallet leg assembly comprising:

a glue panel;

a diagonal panel foldably connected to said glue panel;

an inner side panel foldably connected along a fold line to said diagonal panel;

an inner top panel foldably connected to said inner side panel;

a load-bearing panel foldably connected along a fold line to said inner top panel;

a bottom panel foldably connected to said load-bearing panel;

an outer side panel foldably connected along a fold line to said bottom panel;

an outer load-contacting panel foldably connected to said outer side panel;

said glue panel, said diagonal panel, said inner side panel, and said inner top panel forming a sleeve;

said glue panel extending substantially parallel to said load-bearing panel from a location adjacent to said fold line between said inner top and load-bearing panels;

said fold line between said bottom panel and said outer side panel being adjacent said fold line between said diagonal and said inner side panels;

said outer side panel extending substantially parallel to said inner side panel; and said outer load-contacting panel extending substantially parallel to said inner top panel.

13. The assembly of claim 12, further comprising:

a second outer side panel foldably connected to said load-contacting panel;

a second bottom panel foldably connected along a fold line to said second outer side panel;

a second load-bearing panel foldably connected to said second bottom panel;

a second inner top panel foldably connected along a fold line to said second load-bearing panel;

a second inner side panel foldably connected to said second inner top panel;

a second diagonal panel foldably connected along a fold line to said second inner side panel; and a second glue panel foldably connected to said second diagonal panel; and said second diagonal panel, said second inner side panel, and said second inner top panel forming a sleeve;

said second glue panel extending substantially parallel to said second load-bearing panel from a location adjacent to said fold line between said second inner top panel and said second load-bearing panel;

said fold line between said second bottom panel and said second outer side panel being adjacent said fold line between said second diagonal panel and said second inner side panel;

said second outer side panel extending substantially parallel to said second inner side panel;

said outer load-contacting panel extending substantially parallel to said second inner top panel; and said second load-bearing panel extending substantially parallel to said first load-bearing panel.

* * * * *